US010655321B2

(12) United States Patent
Olson et al.

(10) Patent No.: US 10,655,321 B2
(45) Date of Patent: May 19, 2020

(54) LAP AND PANEL SIDING WITH VENTILATION ELEMENTS

(71) Applicant: LOUISIANA-PACIFIC CORPORATION, Nashville, TN (US)

(72) Inventors: Lance Olson, Nashville, TN (US); Jarrod Kevin Line, Brentwood, TN (US)

(73) Assignee: LOUISIANA-PACIFIC CORPORATION, Nashville, TN (US)

( * ) Notice: Subject to any disclaimer, the term of this patent is extended or adjusted under 35 U.S.C. 154(b) by 0 days.

(21) Appl. No.: 16/211,041

(22) Filed: Dec. 5, 2018

(65) Prior Publication Data

US 2019/0177966 A1 Jun. 13, 2019

Related U.S. Application Data

(60) Provisional application No. 62/594,656, filed on Dec. 5, 2017.

(51) Int. Cl.
*E04B 1/70* (2006.01)
*E04B 1/64* (2006.01)
(Continued)

(52) U.S. Cl.
CPC ..... *E04B 1/64* (2013.01); *E04F 13/007* (2013.01); *E04F 13/0864* (2013.01); *E04F 13/148* (2013.01); *E04F 13/16* (2013.01)

(58) Field of Classification Search
CPC ..... E04B 1/70; E04B 1/7053; E04B 1/7069; E04B 1/7076; E04F 13/0864;
(Continued)

(56) References Cited

U.S. PATENT DOCUMENTS 5,044,823 A 3/1991 Johnsen
5,022,207 A * 6/1991 Hartnett ..... E04D 13/152 52/478

(Continued)

FOREIGN PATENT DOCUMENTS

DE 3329789 A1 3/1985

OTHER PUBLICATIONS

International Search Report and Written Opinion, PCT/US18/64121, Louisiana-Pacific Corporation (international filing date Dec. 5, 2018).

*Primary Examiner* — Chi Q Nguyen
(74) *Attorney, Agent, or Firm* — Wayne Edward Ramage Baker Donelson

(57) ABSTRACT

A plurality of ventilation elements, vents, slots, or gap elements or similar features that are applied to, or machined into, one or more sides of exterior siding products, such as lap siding, panel siding, decorative trim, or other cladding materials. When the exterior siding product is installed, the ventilation elements, vents, slots, or gap elements or similar features provide a built-in air and water gap to facilitate and increase water drainage and air circulation behind the siding or panel, thereby minimizing water storage in the space behind the siding and lowering the equilibrium moisture content of the siding itself. The ventilation features are incorporated into the corresponding product in-line or during the manufacturing process, and do not require any further work during assembly or construction on-site (e.g., furring strips or other similar drainage mechanisms are not needed). Some or all of the ventilation features or elements are located to improve the product's ability to equilibrate (moisture-wise) in a product stack before installation as well as after installation.

16 Claims, 8 Drawing Sheets

(51) Int. Cl.
*E04F 13/08* (2006.01)
*E04F 13/00* (2006.01)
*E04F 13/16* (2006.01)
*E04F 13/14* (2006.01)

(58) Field of Classification Search
CPC ..... E04F 13/007; E04F 13/00; E04F 17/04; E04F 17/00; E04F 13/0869
USPC ..... 52/302.1, 309.3, 302.6, 302.7
See application file for complete search history.

(56) References Cited

U.S. PATENT DOCUMENTS 6,718,699 B1 * 4/2004 Larson ..... E04D 13/178 52/371
7,303,357 B2 * 12/2007 Villarreal ..... E03F 5/0401 220/567.1
7,484,335 B1 * 2/2009 Dunlap ..... E04D 13/152 52/302.3
7,788,877 B2 * 9/2010 Andras ..... E02D 31/02 52/302.1
8,273,208 B2 * 9/2012 Brinner ..... B32B 37/24 156/290
8,756,892 B2 6/2014 Wilson et al.
9,091,049 B2 * 7/2015 Walker ..... E04B 7/20
2006/0068188 A1 3/2006 Morse et al.
2006/0191232 A1 * 8/2006 Salazar ..... E04B 5/043 52/606
2007/0175154 A1 8/2007 Wilson et al.
2010/0147499 A1 * 6/2010 Arai ..... F24F 12/006 165/172
2012/0247040 A1 * 10/2012 Buoni ..... E04B 1/70 52/302.1
2014/0053752 A1 * 2/2014 Hepner ..... E01B 25/08 104/124
2015/0275500 A1 * 10/2015 Dalla ..... E04D 12/004 52/506.01
2016/0319555 A1 11/2016 Norwood et al.
2018/0283013 A1 * 10/2018 Diercks ..... E04B 1/26

* cited by examiner

LAP AND PANEL SIDING WITH VENTILATION ELEMENTS

This application claims benefit of and priority to U.S. Provisional Application No. 62/594,656, filed Dec. 5, 2017, which is incorporated herein by specific reference for all purposes.

FIELD OF INVENTION

This invention relates to a siding or panel product with a plurality of built-in ventilation elements, vents, slots, or gap elements to increase water drainage and/or air circulation.

SUMMARY OF INVENTION

In various exemplary embodiments, the present invention comprises a plurality of ventilation elements, vents, slots, or gap elements or similar features that are applied to, or machined into, one or more sides (e.g., the back side) of exterior siding products, such as lap siding, panel siding, decorative trim, or other cladding materials. When the exterior siding product is installed, the ventilation elements, vents, slots, or gap elements or similar features provide a built-in air and water gap to facilitate and increase water drainage and air circulation behind the siding or panel, thereby minimizing water storage in the space behind the siding and lowering the equilibrium moisture content of the siding itself. The ventilation features are incorporated into the corresponding product in-line or during the manufacturing process, and do not require any further work during assembly or construction on-site (e.g., furring strips or other similar drainage mechanisms are not needed). An effective rain screen assembly thus is created without using furring strips or other form of drainage material, fabric or mat behind the exterior siding product, which results in extending the life of the assembly by reducing the probability of fungal and/or mold growth.

In additional embodiments, some or all of the ventilation features or elements improve the product's ability to equilibrate (moisture-wise) before installation as well as after installation. Prior to installation, the ventilation features or elements allows increased airflow between pieces of the product when stacked, thereby allowing accelerated equilibrium of the pieces of product in the middle or the interior of the stack (in the absence of the present invention, product in a stack will differentially equilibrate, as pieces of the product in the middle or the interior of the stack will not be exposed to air flow). Accelerated equilibrium minimize the amount of expansion or contraction of the product after installation. This stabilization of the product provides greater ease and flexibility in installation and lower probability of post-installation issues such as, but not limited to, buckling, shrinkage, excessive vapor drive through the paint, and other similar issues.

DETAILED DESCRIPTION OF EXEMPLARY EMBODIMENTS

In various exemplary embodiments, the present invention comprises a plurality of ventilation elements, vents, slots, or gap elements or similar features that are applied to, or machined into, one or more sides (e.g., the back side) of exterior siding products, such as lap siding, panel siding, decorative trim, or other cladding materials. When the exterior siding product is installed, the ventilation elements, vents, slots, or gap elements or similar features provide a built-in air and water gap to facilitate and increase water drainage and air circulation behind the siding or panel, thereby minimizing water storage in the space behind the siding and lowering the equilibrium moisture content of the siding itself. The ventilation features are incorporated into the corresponding product in-line or during the manufacturing process, and do not require any further work during assembly or construction on-site (e.g., furring strips or other similar drainage mechanisms are not needed). An effective rain screen assembly thus is created without using furring strips or other form of drainage material, fabric or mat behind the exterior siding product, which results in extending the life of the assembly by reducing the probability of fungal and/or mold growth.

In additional embodiments, some or all of the ventilation features or elements improve the product's ability to equilibrate (moisture-wise) before installation as well as after installation. Prior to installation, the ventilation features or elements allows increased airflow between pieces of the product when stacked, thereby allowing accelerated equilibrium of the pieces of product in the middle or the interior of the stack (in the absence of the present invention, product in a stack will differentially equilibrate, as pieces of the product in the middle or the interior of the stack will not be exposed to air flow). Accelerated equilibrium minimize the amount of expansion or contraction of the product after installation. This stabilization of the product provides greater ease and flexibility in installation and lower probability of post-installation issues such as, but not limited to, buckling, shrinkage, excessive vapor drive through the paint, and other similar issues.

Figure 1:
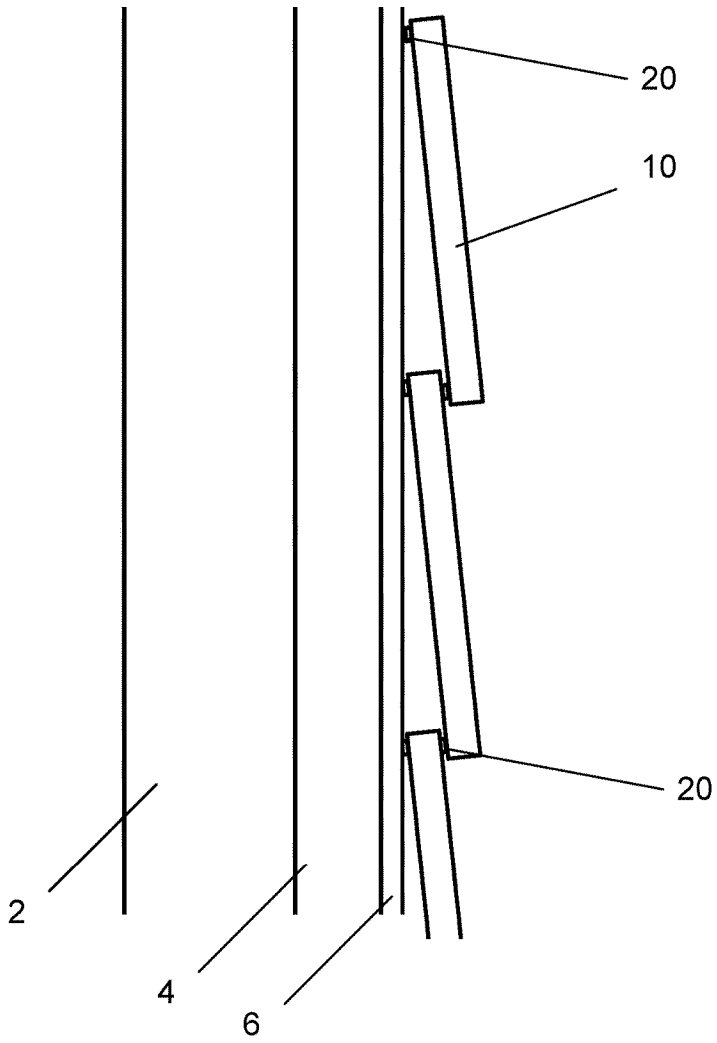
FIG. 1 shows a cross-sectional view of a siding assembly with lap siding product with top and bottom ventilation features in accordance with an embodiment of the present invention.

FIG. 1 shows a side cutaway view of an exemplary wall assembly with lap siding with ventilation features. OSB 4 or similar sheathing is affixed to a wall or frame stud 2, and a wall wrap 6 (e.g., weather resistant barrier, WRB, Tyvek, felt, or the like) is applied to the exterior side of the OSB sheathing 4. Exterior-facing siding sheathing 10 (e.g., lap siding, or siding panels) is then affixed over the wall wrap. Row of ventilation features 20 are positioned across the top and bottom of the back side or face of the siding sheathing 10, adjacent or proximate the top edge or bottom edge. As seen, the top ventilation features contact the wall wrap (or OSB sheathing, if no wall wrap is used) and provide a series of ventilation gaps between the features allowing the passage of water and/or air. Similarly, the bottom ventilation features contact the top exterior face of the lap siding or panel below, and provide a series of ventilation gaps between the features allowing the passage of water and/or air. Variations of this configuration can be used.

Figure 2:
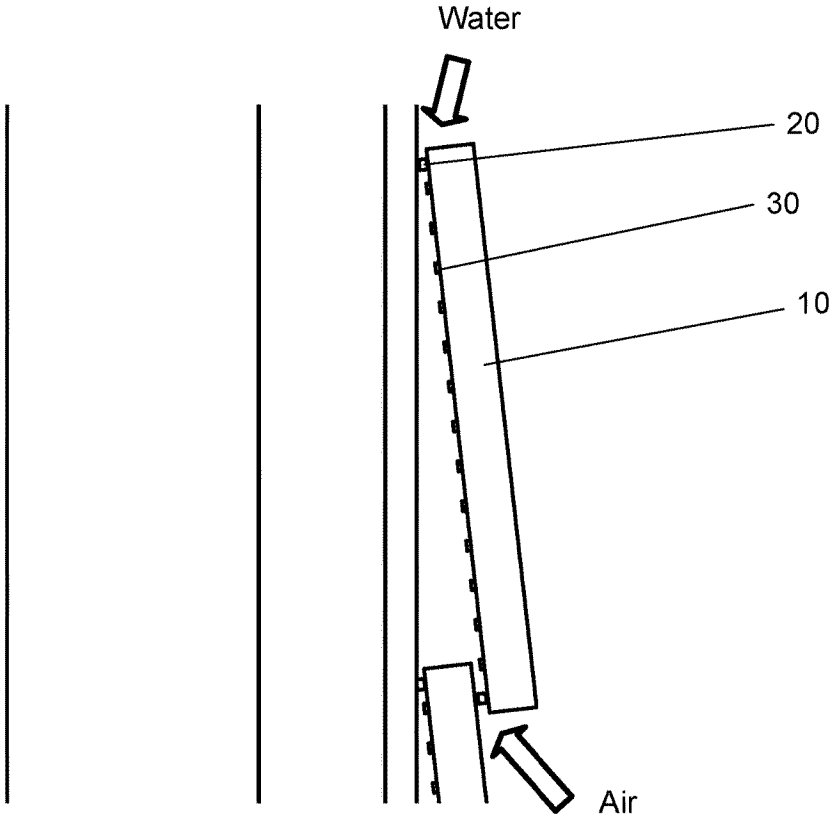
FIG. 2 shows a cross-sectional view of the lap siding product of FIG. 1 with additional ventilation features.
Figure 3:
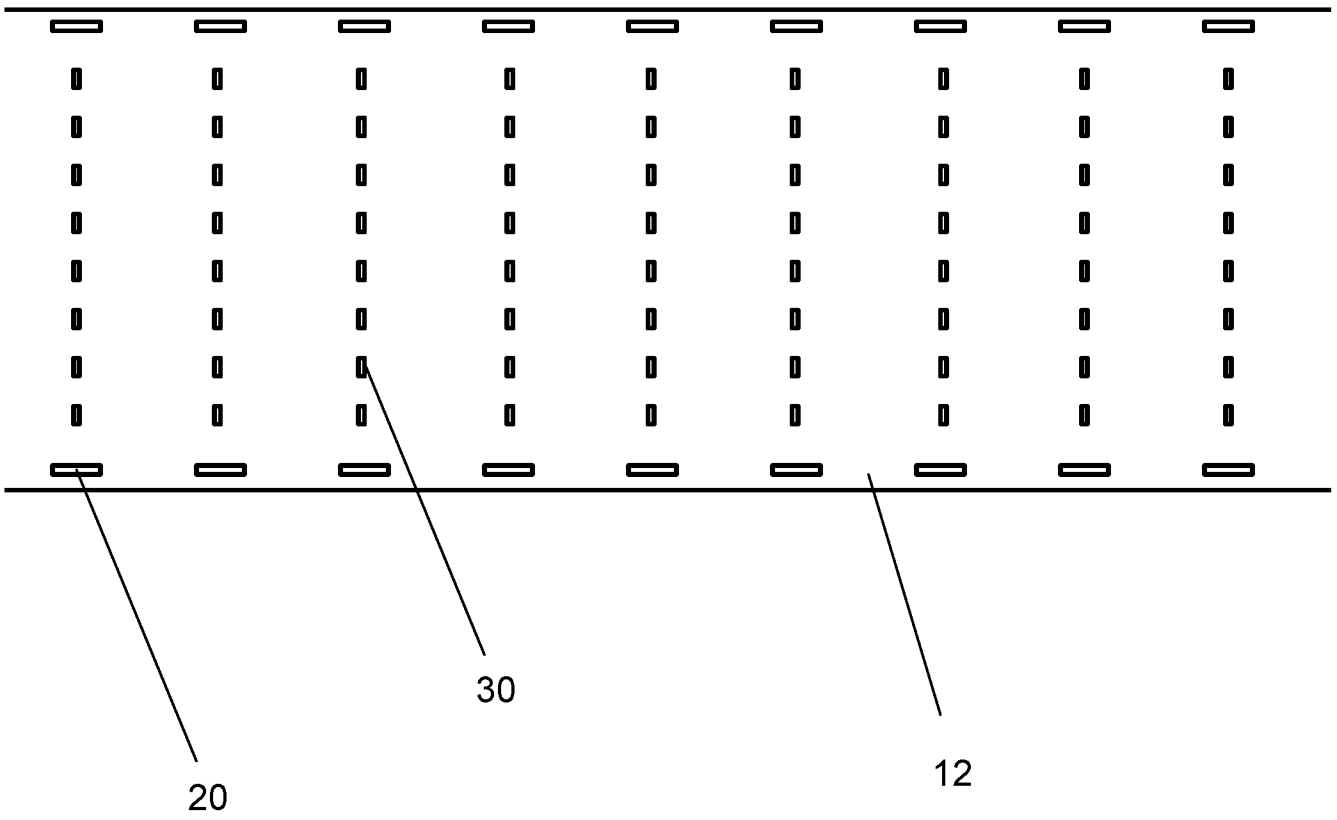
FIG. 3 shows a back view of a section of the lap siding product of FIG. 2.

FIGS. 2 and 3 show additional views of the top and bottom edge ventilation features 20 in combination with a variety of central or middle ventilation elements 30. FIG. 2 shows a cross-sectional view similar to FIG. 1, but with a series of middle ventilation elements 30 running down the back of the lap siding sheathing 10. FIG. 3 shows a view of the back of a single lap siding panel (oriented horizontally, as it would be applied in FIG. 1), showing both forms of ventilation features in more detail. The top and bottom ventilation features 20 here comprise a series of raised elements, strips, or beads located along or proximate the upper and lower edges of each lap panel. In one embodiment, each raised feature 20, 30 is ¾" to 1" long, and ⅛" to ¾" high. When in linear form, the width of each element is less than the length, but generally not less than approximately 1/16" in width (e.g., in one embodiment, approximately ⅛" to ½" in width). The features 20 shown here are linear, and extend lengthwise parallel to the upper and lower edges of the siding sheathing 10, although other shapes and alignments are possible. These features provide for a plurality of fixed gaps or spacing at the lap joint and at the wall connection when assembled, as seen in FIGS. 1 and 2. (While the figures herein show various combinations of ventilation features and other similar elements on either a piece of lap siding or panel siding, the various combinations shown can be used on other types of siding, or on other strips, planks, panels or similar products.)

The middle ventilation features 30 are shown here as a plurality of vertical columns of raised elements extend vertically between the upper and lower edges of each piece of lap siding or panel. The features 30 in the vertical columns may differ in size (length, width, and/or thickness) from the top/bottom raised elements 20. In one embodiment, all elements are the same height/thickness. In another embodiment, the top/bottom raised elements 20 are greater in height/thickness than the central elements 30. The top elements also may be greater or lesser in height that the bottom elements, and the central elements likewise may differ in height among themselves. As described below, the vertical columns of middle elements 30 also may facilitate stacking of the lap siding or panel sheathing for shipping, and allow for air and water ventilation when stacked while preventing bowing of or damage to the panels.

Figure 4:
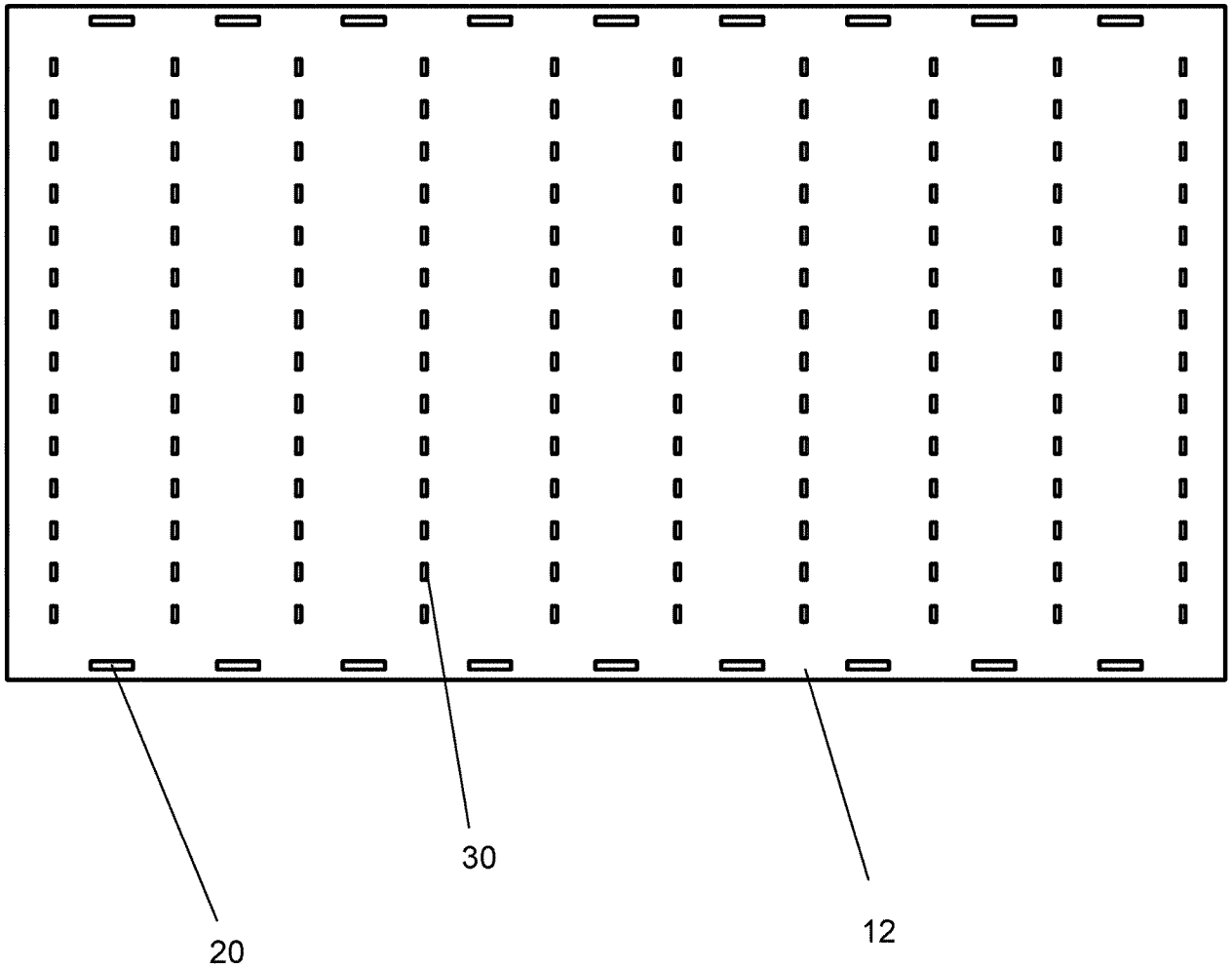
FIG. 4 shows an alternative configuration of ventilation features on the back of a panel siding product.

The vertical columns of middle elements 30 may be aligned with the top/bottom elements 20, as seen in FIG. 3, or may be offset therefrom, as seen in FIG. 4. Various configurations and alignments of elements may be used to variously provide straight or unobstructed ventilation channels, whether unidirectional, bidirectional, or multi-directional, or more distributed or greater or consistent support across the width and length of the sheathing panel.

Figure 5:
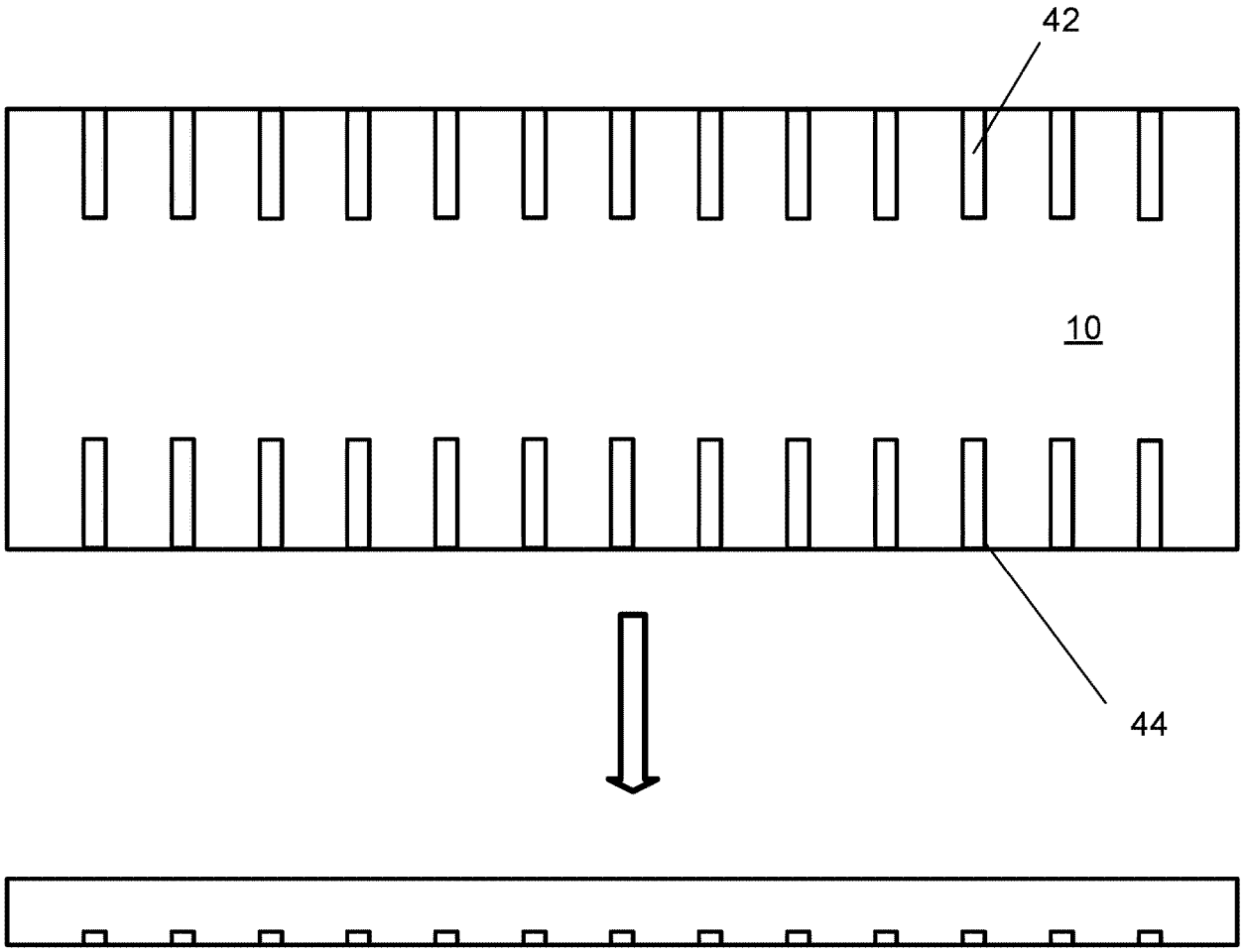
FIG. 5 shows a back view of a lap siding product with ventilation or drainage channels in accordance with another embodiment of the present invention.

FIG. 5 shows another embodiment of the present invention, with a portion of a piece of lap siding with a plurality of ventilation or drainage slots or channels 42, 44 cut into the back side (e.g., in the bottom layer of a multilayered manufactured wood product) of the lap siding product along the upper 42 and lower edges 44. When assembled (such as seen in FIG. 1), the slots create drainage/ventilation channels and facilitate air and water flow at the lap joint and at the wall connection. In alternative embodiments, channels may be positioned only along the top or along the bottom. Each channel has an opening along the bottom or top edge, respectively, and extends for some distance towards the interior. In some embodiments, a channel extends from the top edge continuously to the bottom edge. While FIG. 5 shows the channels as extending at substantially right angles relative to the top or bottom edges, the channels may extend straight at non-right angles, or may be S-shaped or curved, or combinations thereof. The channels may also be used alone, or in various combinations with the raised ventilation features described above.

Figure 6:
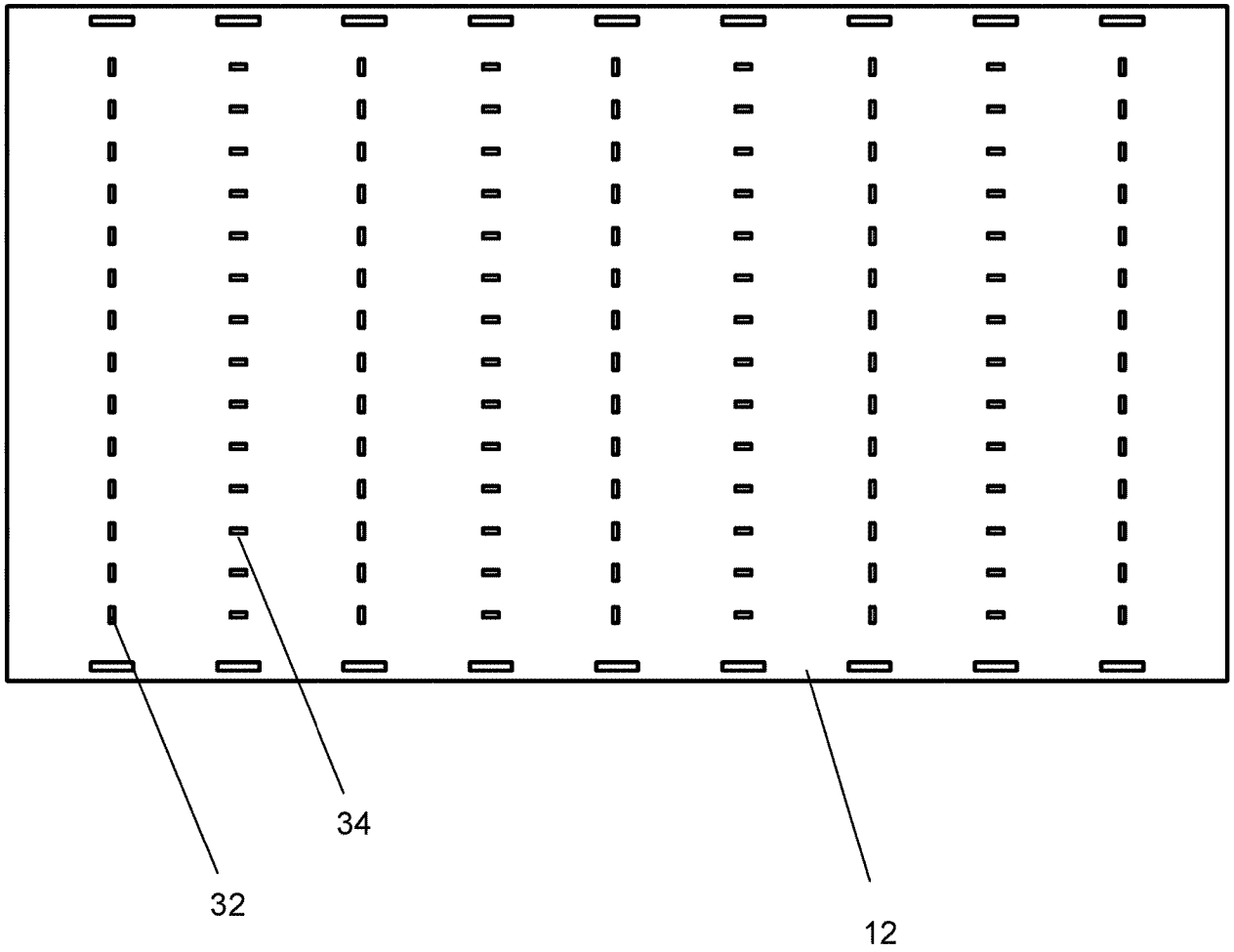
FIG. 6 shows a back view of a panel siding product with ventilation features in accordance with another embodiment of the present invention.
Figure 7:
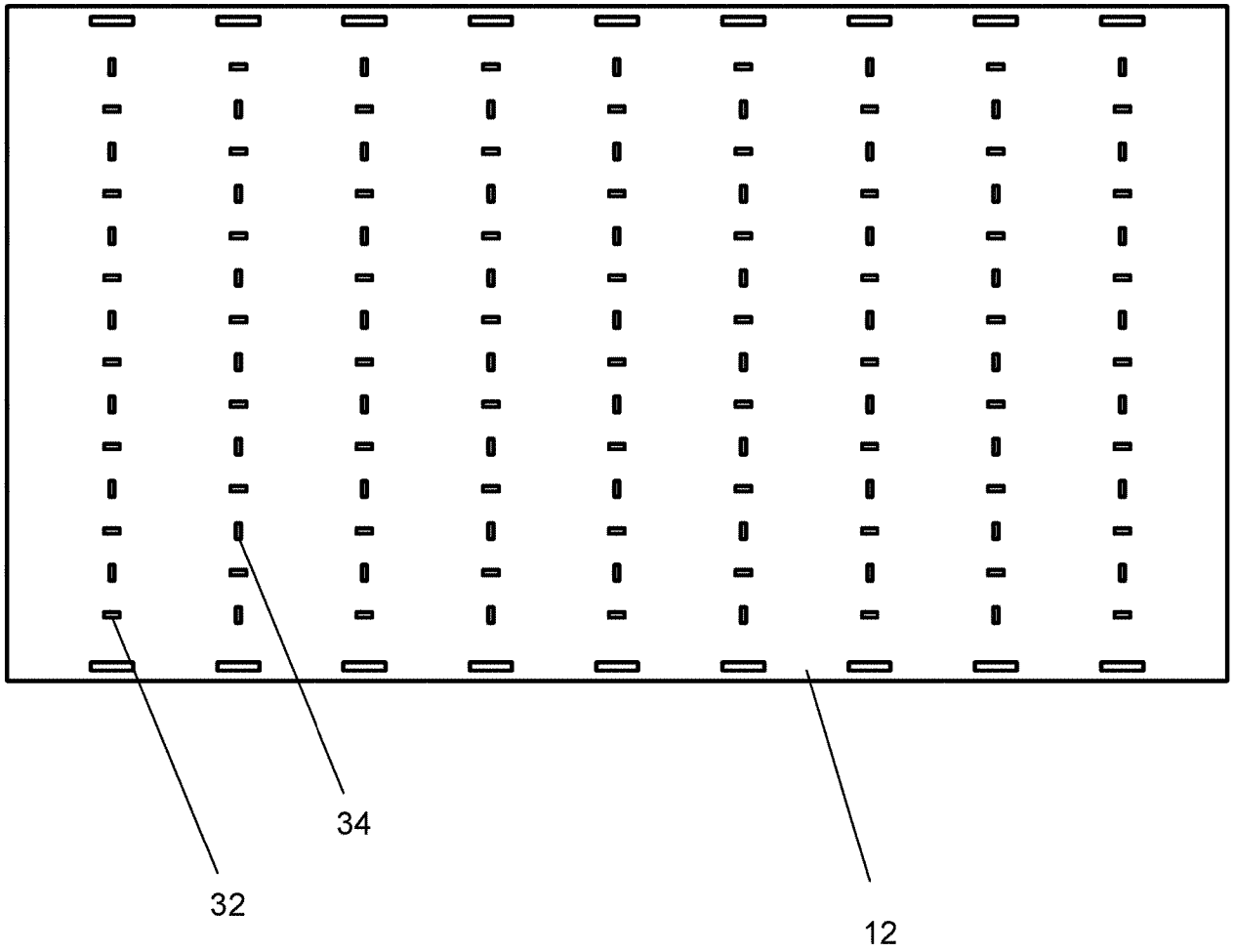
FIG. 7 shows an alternative configuration of ventilation features for the panel siding product of FIG. 6.

FIG. 6 shows an embodiment of the present invention where a plurality of raised features 32, 34 are applied to the back side of a panel siding product (such as where the panel is 4'×8' or larger). The top/bottom raised features described above may or may not be present. Each raised element, when in linear form, is ½" to 1" long, and ⅛" to ¾" high, and spaced 2" to 4" from adjacent elements. Width may be as described above with regard to features 20, 30. In other embodiments, different dimensions and/or spacing may be used. In one embodiment, each column of elements is similarly aligned (e.g., all horizontal or all vertical), with columns alternating in alignment (the same may be true for rows). The raised features in alternating columns (or rows) can be vertically aligned, as shown, or offset. In another embodiment, the features in a column also may alternate alignment, as seen in FIG. 7. These configurations allow a siding panel to be installed either vertically or horizontally. The elements facilitate stacking of the lap panels for shipping, and allow for air and water circulation when stacked while preventing bowing of or damage to the panels.

Figure 8:
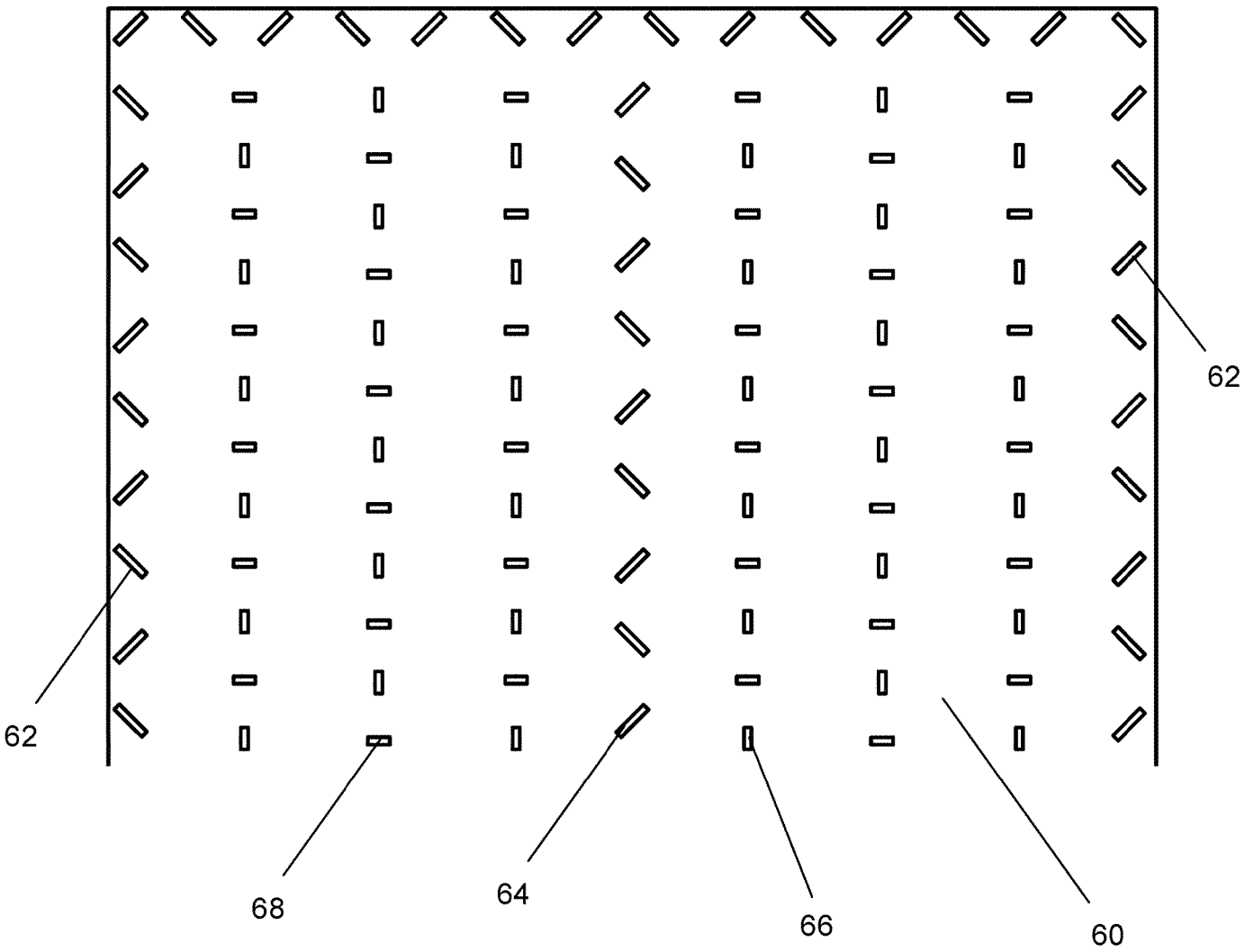
FIG. 8 shows an back view of a panel siding product with multiple patterns of ventilation features positioned for various installation or stacking arrangements.

In several embodiments, multiple forms and arrangements of ventilation features are applied to the same panel or board. For example, FIG. 8 shows an example of a portion of the back of a panel 60 with multiple orientations and forms of ventilation elements. The panel shown is 4'×8', although the panel may be other sizes. The outside edges contain a series of alternating orientation angled linear features 62 (which are shown at an angle to the edges), in a strip within up to 6" from the edge (in one preferred embodiment, the features are located within a strip up to 1" from the respective edge). One or more similar strips of alternating orientation angled linear features 64 extend across the middle of the panel (in the figure shown, a single interior strip up to approximately 6" wide, preferably up to 1" wide, extends down the center section of the panel; in the embodiment shown, a single interior strip extends down the center, 24" from either long edge). These features provide drainage when attaching the panel over one or more studs during installation, and are designed to correspond to stud placement (these strips thus may extend horizontally, vertically, or both, depending on the installation).

Further, additional ventilation features 66, 68 may be provided on the interior of the back side of the panel to provide ventilation for when the product is stacked, as described above. The placement in the interior helps to keep the panels slightly separated from stacked, and these additional ventilation features may comprise a third 66 and fourth 68 alternating orientation to the stud features (e.g., alternating perpendicular and parallel to a panel edge, as shown). The stack ventilation features also may be used for providing ventilation and/or drainage for other forms of installation of the product.

The different features may vary in thickness, length, and composition, in addition to orientation and arrangement. In the example shown in FIG. 8, the features' thickness may range from ⅛" to ½".

In another embodiment, alternative, non-linear shapes are applied to the features in these strips corresponding to the stud placement, and in the field in between to aid in stacking of materials into bundles.

In some embodiments, a starter strip is used to start the installation of lap siding. The starter strip can be a specially designed strip installed on the wall at the bottom of the installation (as a base for the first row of lap siding), although many times a starter strip is cut from a piece of the lap siding being used for the project. This area is often a point of trapped moisture and restricted ventilation. While a bottom edge ventilation element 20 on the row of lap siding being installed over the starter strip may provide ventilation, in some installations the starter strip itself may comprise one or more lines of ventilation elements (as described above) on its exterior face or side.

The siding or cladding may be manufactured from a variety of materials utilized for such purposes, including, but not limited to, wood, engineered wood composites (e.g., OSB, LVL, and the like), and cellulose fiber cement.

The product can be manufactured using several different processes. Material can be attached to the back of the siding creating a pattern of raised points that facilitate drainage and ventilation. In several embodiments, as detailed below, the pattern or patterns are not omnidirectional. Specific shapes of polymer or other materials can be applied to the backside of the product or board backer. These shapes include, but are not limited to, thin and thick lines, ridges, or linear features of various lengths and angles, dots, circles and other shapes which impart certain properties. This process allow for shapes of various sizes and thicknesses to be applied to optimize cost and product performance. Polymer or other materials which could be applied include but not limited to heat sensitive materials, 2-part resins, and other forms of solid materials adhered to the panel or board.

In various of the figures shown, the additive technologies add hard polymer shapes as ventilation features around the outside edge and center of the panel to provide gaps between the panel and wall (or between adjacent panels in a pre-installation stack) for air circulation and moisture drainage.

The drainage and ventilation feature(s) can also be machined into the product using saws, routers or other types of tooling, or they can be pressed into the product to create a woven, dimpled or other contoured surface.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. An exterior cladding product, comprising:

a piece of wood-based exterior cladding comprising a front side, a back side, atop edge, a bottom edge, a right side, and a left side;

a first line of a plurality of first ventilation features extending along the back side adjacent to the top edge;

a second line of a plurality of second ventilation features extending along the back side adjacent to the bottom edge;

at least one third line of a plurality of third ventilation features extending across the back side between the top edge and the bottom edge; and a plurality of drainage slots or channels cut into the back side from the bottom edge and extending partially across the back side;

wherein the third ventilation features are oriented at an angle to the first ventilation features.

2. The product of claim 1, wherein said at least one third line of the plurality of third ventilation features extends vertically between one of said first ventilation features and a corresponding one of said second ventilation features.

3. The product of claim 1, wherein the first ventilation features are linear, and are parallel to the top edge.

4. The product of claim 1, wherein the second ventilation features are linear, and are parallel to the bottom edge.

5. The product of claim 1, further comprising a plurality of drainage slots or channels cut into the back side from the top edge and extending partially across the back side.

6. An exterior cladding product, comprising:

a wood-based exterior cladding panel comprising a front side, a back side, a top edge, a bottom edge, a right side, and a left side;

a first set of ventilation features comprising a plurality of raised elements projecting from the back side;

a second set of ventilation features comprising a plurality of raised elements projecting from the back side; and a plurality of drainage slots or channels cut into the back side from the bottom edge and extending partially across the back side;

wherein the features in said first set of ventilation features are oriented at an angle to the features in second set of ventilation features.

7. The product of claim 6, wherein the raised elements are attached to the back side of the panel.

8. The product of claim 6, wherein the raised elements are polymers.

9. The product of claim 6, wherein the first set of ventilation features and the second set of ventilation features are arranged to provide ventilation and drainage whether the panel is installed in a vertical or horizontal orientation.

10. An exterior cladding product, comprising:

a wood-based exterior cladding panel comprising a front side, a back side, a top edge, a bottom edge, a right side, and a left side;

a first set of ventilation features comprising a plurality of raised elements projecting from the back side adjacent to the top, bottom, right and left edges;

a second set of ventilation features comprising a plurality of raised elements projecting from the back side in a row or column between the top edge and bottom edge;

a third set of ventilation features comprising a plurality of raised elements projecting from the back side;

a fourth set of ventilation features comprising a plurality of raise elements from the back side; and a plurality of drainage slots or channels cut into the back side from the bottom edge and extending partially across the back side;

wherein the third and fourth sets of ventilation features do not overlap with the first set of ventilation features.

11. The product of claim 10, wherein the raised elements are attached to the back side of the panel.

12. The product of claim 11, wherein the raised elements are polymers.

13. The product of claim 10, wherein the first set of ventilation features comprise alternating linear features oriented at an angle to the respective edge.

14. The product of claim 10, wherein the second set of ventilation features are positioned to correspond to a wall stud for installation.

15. The product of claim 10, wherein the third set of ventilation features are positioned to provide ventilation between adjacent panels in a multiple-panel stack.

16. The product of claim 10, wherein the third set of ventilation features are positioned to accelerate equilibration by the panel when placed in a multiple-panel stack prior to installation.

* * * * *